United States Patent [19]

Johnson

[11] Patent Number: 4,619,062

[45] Date of Patent: Oct. 28, 1986

[54] SAFETY DEVICE FOR FIREARMS USING REMOVABLE MAGAZINES

[76] Inventor: David A. Johnson, 3432 Tanglewood Way, Salem, Oreg. 97302

[21] Appl. No.: 785,577

[22] Filed: Oct. 8, 1985

[51] Int. Cl.[4] ..... F41C 11/02

[52] U.S. Cl. ..... 42/70.11; 42/49.02; 42/70.02

[58] Field of Search ..... 42/1 LP, 70 A, 49 A

[56] References Cited

U.S. PATENT DOCUMENTS

| | | | |
|---|---|---|---|
| 2,997,802 | 8/1961 | Robbins | 42/1 LP |
| 3,085,360 | 4/1963 | Robbins et al. | 42/1 LP |
| 3,089,272 | 5/1963 | McKinlay | 42/1 LP |
| 3,605,311 | 9/1971 | Hermann | 42/1 LP |
| 3,710,490 | 1/1973 | Cornett et al. | 42/1 LP |
| 4,384,420 | 5/1983 | Von Muller | 42/1 LP |
| 4,528,765 | 7/1985 | Johnson | 42/1 LP |

OTHER PUBLICATIONS

*The Sunday Star,* "Sportsman Digest", by Hal Sharp, Locked Gun Tip, Washington DC, Oct. 26, 1969, p. G-9, (newspaper).

*Primary Examiner*—Deborah L. Kyle
*Assistant Examiner*—Michael J. Carone
*Attorney, Agent, or Firm*—Chernoff, Vilhauer, McClung & Stenzel

[57] ABSTRACT

A safety device for a repeating firearm includes a main body which fits in the magazine well of the firearm, closing its outer end. An outer end of the main body is clearly visible at the outer end of the magazine well when the main body is properly located therein. A chamber-blocking member movably attached to the main body excludes cartridges from the firing chamber of the weapon and, in one embodiment of the invention, includes a barrier which prevents a firing pin from reaching the primer of a cartridge which may be located in the firing chamber undetected. The chamber-blocking member, in one embodiment of the invention, is pivotably attached to the main body. In another embodiment of the invention the chamber-blocking member is a cylindrical plug attached to the main body by a flexible cable.

20 Claims, 7 Drawing Figures

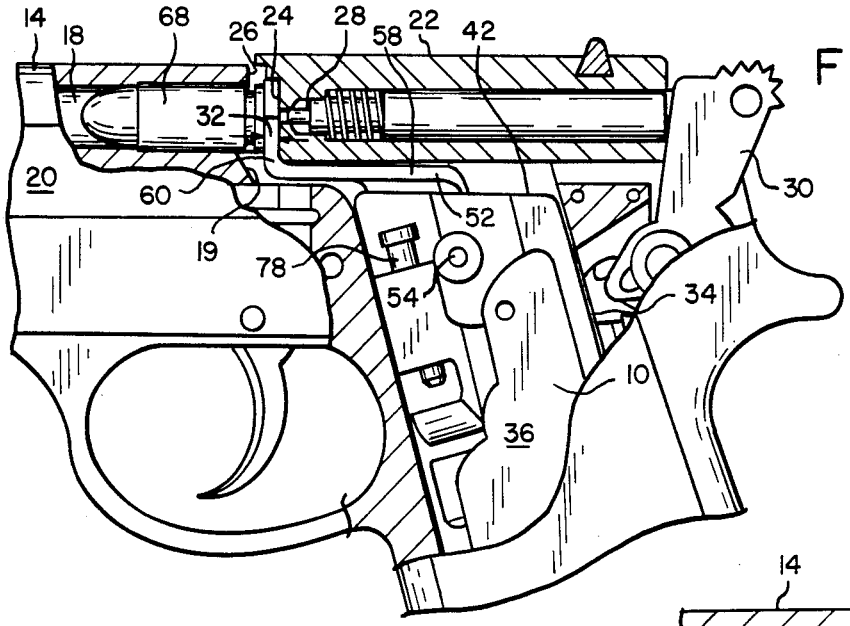
FIG. 6
FIG. 5
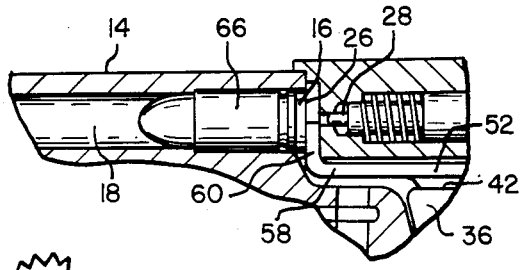
FIG. 7
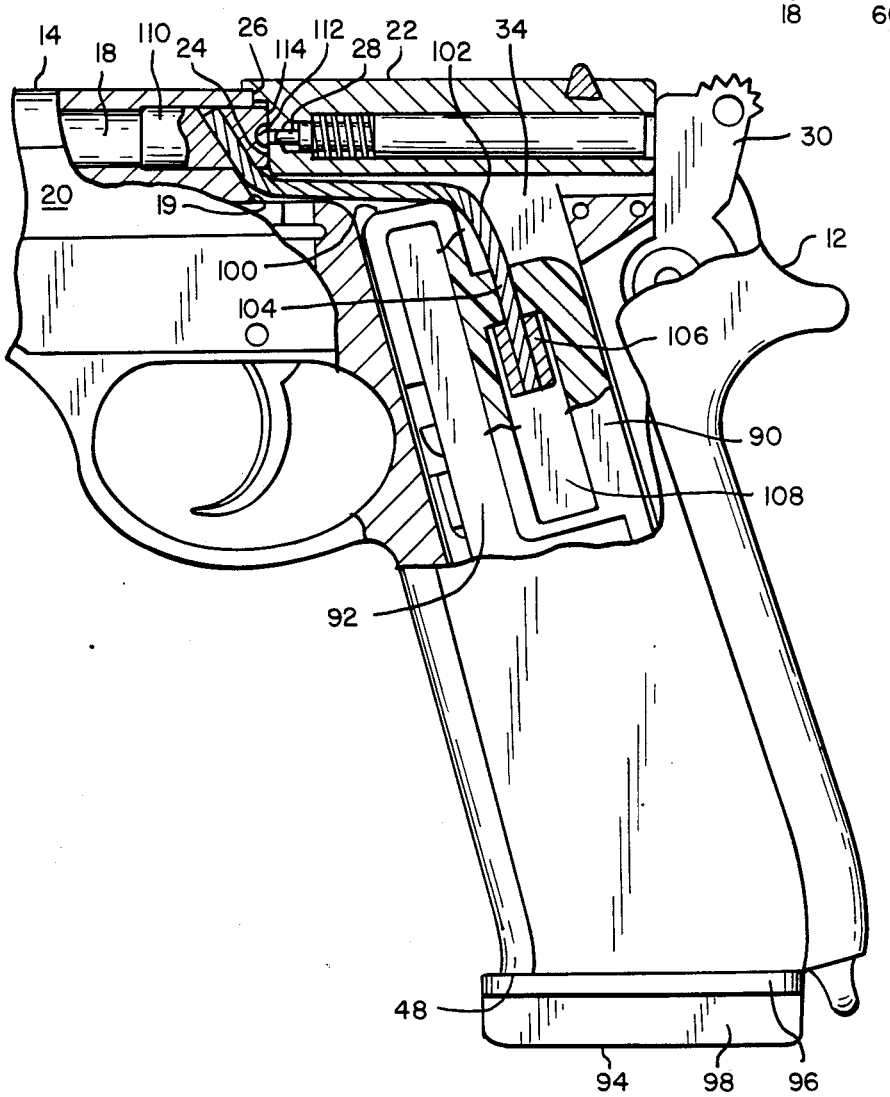

SAFETY DEVICE FOR FIREARMS USING REMOVABLE MAGAZINES

BACKGROUND OF THE INVENTION

The present invention relates to firearms safety, and in particular to a device for use with a repeating firearm for preventing discharge of a cartridge, yet permitting the action of the firearm to be operated.

Many repeating firearms utilize replaceable magazines, which, when in place in such firearms, exclude dirt, sand, and the like from entering internal mechanisms and doing damage or causing failure of the firearms to operate properly. When the replaceable magazine is not in place in such a weapon, however, the loading mechanism and other movable parts of the weapon are exposed to contamination by material carried in the air or otherwise found in the immediate environment. While it is possible to protect the internal mechanisms of such a firearm against dirt by keeping a magazine in the magazine well, it is often desired to keep such a weapon in an unloaded condition.

Placement of a magazine in the magazine well always includes the risk that a cartridge may accidentally be loaded into the firing chamber of the weapon.

Safety is of prime importance in conducting training in the use of firearms. For the sake of safety, then, it has been the custom in the past during military training operations for firearms to be carried with the magazine removed, to prevent accidental loading of a cartridge into the chamber. Use of a weapon without its magazine, however, exposes the inner mechanisms of a firearm to contamination. Particularly when weapons are used in this manner in desert sand conditions, there is a significant likelihood of firearm malfunction during later use, unless such firearms are first carefully cleaned. Such cleaning requires an undesirably long time for readying firearms for service use after use in such training exercises.

It is necessary to be able to carry out training exercises safely, but without excessive risk of damage to weapons, and without requiring an unduly long period of time to make weapons ready for actual use after training use.

Not only is it desirable for weapons to be in a safe condition during training in their use, but it is also desirable that such a safe condition should be easily and quickly verifiable from a distance of at least several meters.

Prior efforts to provide a way to make a firearm safe from accidental firing without disassembling the firearm include a chamber plugging device shown in Robbins U.S. Pat. No. 2,997,802. The Robbins device is useable particularly in a bolt action rifle to plug the firing chamber and interfere with closure of the bolt of such a weapon. The Robbins device, however, has no provision for preventing entry of contamination through a magazine well of a repeating firearm from which a magazine has been removed as a safety measure.

McKinlay U.S. Pat. No. 3,089,272 and Hermann U.S. Pat. No. 3,605,311, disclose key-locked devices which fit inside the receivers of automatic-loading shotguns and similar automatic-loading weapons. These devices close the empty case ejection port of such weapons and prevent the bolt from closing the breech. Such devices, however, do not protect the working mechanisms of an automatic-loading firearm from which a magazine has been removed, leaving the magazine well open. Additionally, the McKinlay and Hermann devices would seem to be clearly visible only from one side of weapons in which they are installed.

Johnson U.S. Pat. No. 4,528,765, discloses an externally visible safety device for firearms which is particularly adapted to automatic rifles similar to the M-16 military rifle used by the armed forces of the United States. While this device is adequate for rifles including ejection port covers, in order to make such rifles safe, without exposing their inner mechanisms to contamination, such a device keeps the breech bolt in an open position and does not permit operation of the action of such an automatic rifle for practice and familiarization purposes.

In training personnel in the use of firearms, it is often desirable to operate the loading and empty case ejecting mechanisms of the firearm, to cock the firearm, and to practice the proper manner of squeezing the trigger of the firearm, without actually expending ammunition. To ensure safety during such practice, it is desirable to have a safety device which would prevent discharge of a cartridge located in the cartridge receiving and firing chamber of a firearm being used in such training. Without such a safety device, it is possible that a cartridge could be discharged accidentally, even though the magazine is removed from a weapon.

What is needed, then, is a safety device which will positively prevent a firearm, particularly a firearm such as a semi-automatic pistol, from being fired accidentally, even though a cartridge may be present in the firing chamber, and which will make it easily verifiable visually, from a considerable distance away from the firearm, that the firearm is incapable of being fired. Such a device should ideally be inexpensive, positive in its effect, and easy to use, and should allow the firearm to be made safe without thereby exposing internal working parts of the action to contamination. Additionally, such a safety device should be easily removable so as to leave the weapon quickly able to be fired reliably.

Additionally, a safety device for use in training should, ideally, permit simulation of all normal operations required for use of the weapon, including practice in removing and replacing a magazine, with complete safety.

SUMMARY OF THE INVENTION

The present invention overcomes the aforementioned shortcomings and disadvantages of safety device for firearms by providing a safety device adapted for insertion into the magazine well of a semi-automatic firearm, preventing insertion of a magazine into the magazine well of such a weapon and blocking the breech of the cartridge receiving and firing chamber, so that cartridges can neither be inserted into the chamber nor discharged if already present in the chamber.

The safety device of the present invention includes a main body which fits within the magazine well of an automatic-loading firearm in place of the normal magazine for the firearm. Attached to an inner end of the main body of the safety device of the present invention is a chamber-blocking member which prevents insertion of a cartridge into the cartridge-receiving chamber at the breech end of the barrel of the firearm.

In a preferred embodiment of the invention the chamber-blocking member is pivotably attached to the inner end of the main body of the device, and includes a breech-blocking barrier which prevents the breech block or equivalent portion of the firearm from being closed fully if a cartridge is present in the firing chamber. Furthermore, the chamber-blocking member fits ahead of the breech block or equivalent part of the firearm and prevents the firing pin of the firearm from reaching the primer of a cartridge of an improper size which may have been accidentally placed in the chamber of the firearm.

An outer end of the safety device closes the magazine well to prevent entry of materials which might contaminate and damage the mechanisms within the firearm. The outer end is intended to be easily visible and has a shape and color which contrast clearly with the appearance of the magazine for the firearm, so that it can be determined easily from a reasonable distance that the safety device, and not the magazine, is present in the firearm.

The main body may be made of a molded plastics material, in order to minimize unit cost.

The chamber-blocking element may be a pivotably attached member which fits between breech block and firing chamber breech portions of the firearms, and which is movable between a position required for insertion into the weapon via its magazine well and a position in which it prevents insertion of a cartridge into the chamber. In the latter position a breech barrier portion prevents discharge of a cartridge already located in the chamber, as the breech barrier is of material thick enough to prevent contact of the weapon's firing pin against the primer of a cartridge.

It is therefore a primary object of the present invention to provide a safety device for use with a repeating firearm to make it safe to use such a firearm in familiarization and training of personnel.

It is another important object of the present invention to provide a safety device for a repeating firearm which prevents a cartridge from being loaded into the firearm and prevents any cartridge already present in the firing chamber of the firearm from being discharged.

It is a further object of the present invention to provide a safety device which prevents entry of contaminating materials into the action of a repeating firearm, while preventing the firearm from being discharged.

It is an important feature of the present invention that it includes a clearly visible outer end which indicates that the safety device is operatively in place in the firearm.

It is another important feature of the present invention that it includes a barrier which prevents the firing pin of a firearm from making contact with the primer of a cartridge which may be located in the firing chamber of the firearm.

It is a principal advantage of the safety device of the present invention that it safely permits more complete manipulation of the action of a firearm while the safety device is installed than is possible with previously known safety devices.

It is another advantage of the present invention that it permits operation of a firearm, including simulation of loading the firearm, with greater safety than has previously been possible.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIG. 5 is a sectional detail view, taken from the left side, of the pistol and safety device shown in FIG. 1, with a short cartridge located within the firing chamber of the pistol.

FIG. 6 is a partially cut away view of a portion of the pistol and safety device shown in FIG. 1, with a cartridge in the firing chamber of the pistol.

FIG. 7 is a partially cut away view of the pistol shown in FIG. 1, together with a safety device which is another embodiment of the present invention installed therein.

DETAILED DESCRIPTION OF THE INVENTION

Figure 1:
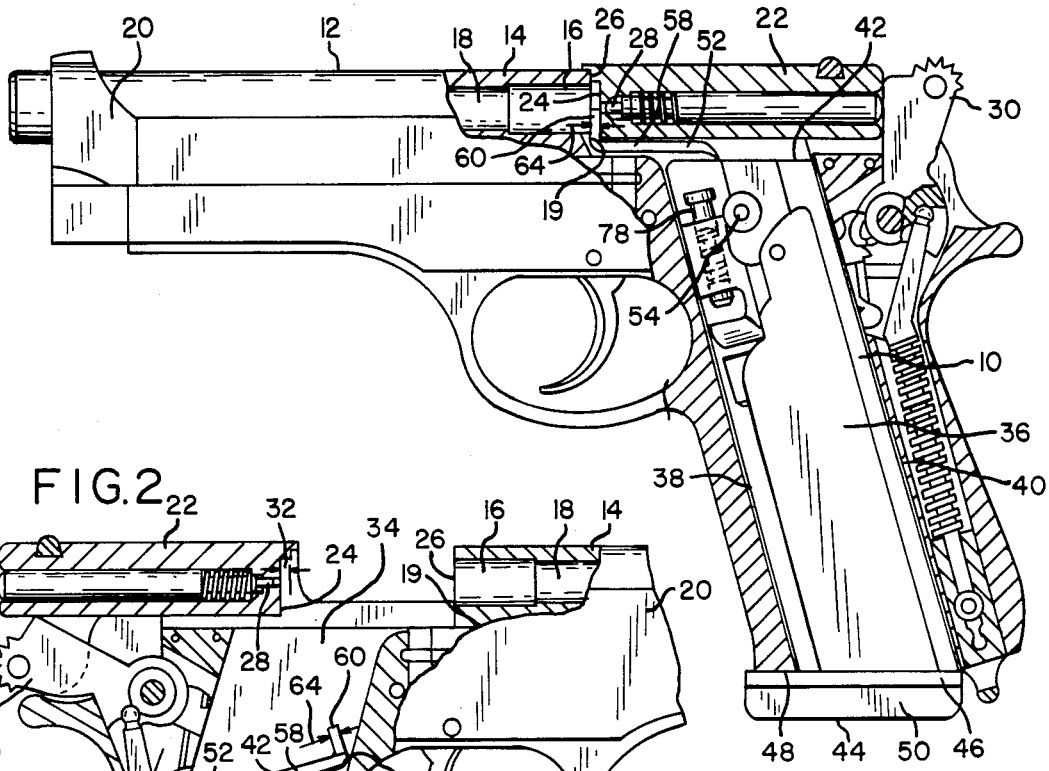
FIG. 1 is a partially cut away view, taken from the left side of an automatic-loading pistol in which a safety device embodying the present invention is installed.
Figure 2:
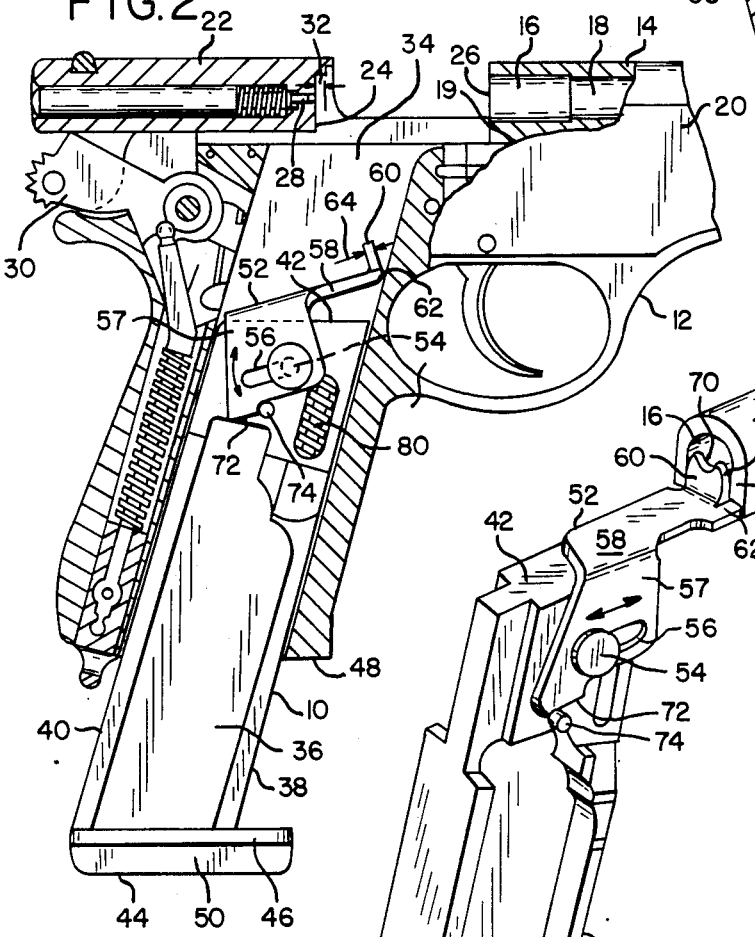
FIG. 2 is a partially cut away view, taken from the right side, of a portion of the pistol and safety device shown in FIG. 1.

Referring now to the drawings, in FIGS. 1 and 2 a safety device 10 is shown in place in an automatic-loading pistol, which is shown partially cut away in FIGS. 1 and 2. The pistol 12 includes a barrel 14 defining a cartridge receiving and firing chamber 16 at the breech end of the barrel. As is customary, the chamber 16 has a slightly larger diameter than the rifled bore 18. A loading ramp 19 is located at the lower, rear portion of the chamber 16 to guide cartridges into the chamber 16 as the automatic loading action of the pistol is operated. A slide 20 includes a breech-block portion 22 whose forward face 24 ordinarily supports the base of a cartridge located properly within the chamber 16. A breech face 26 ordinarily limits forward movement of the slide 20, including the breech block 22, when the pistol 12 is in a ready-to-fire condition with a cartridge located within the chamber 16. A firing pin 28 includes a small forward portion which ordinarily is located rearwardly from the front face 24 of the breech block 22. When the firing pin 28 is driven forward by impact of the hammer 30, the forward portion of the firing pin 28 momentarily protrudes forwardly through an orifice provided in the forward face 24 of the breech block 22, to impact against a primer of a cartridge in order to discharge the cartridge. As is well known, the forward movement of the firing pin 28 is limited to a maximum protrusion 32 by the design of a firearm. A magazine well 34 extends upwardly through the handle portion of the pistol and normally receives a magazine filled with cartridges.

The safety device 10 includes a main body 36 having a front side 38, a rear side 40, an inner end 42, and an outer end 44. The main body 36 is of a size which fits slidingly within the magazine well 34 in generally the same manner in which a magazine (not shown) would fit within the magazine well 34. The main body 36 is preferably made of a strong plastics material, such as a high-density Nylon material, which may be injection molded in a shape which maintains the position of the main body 36 within the magazine well 34. The main body 36 need not be solid. Instead, the main body 36 may include a central web and forward and rear marginal portions as shown, or it may be of a hollow construction. In any case, however, the outer end 44 is large enough and is appropriately shaped to close the magazine well 34, for example including a bottom plate 46 which fits closingly against the butt 48 of the pistol around the magazine well 34 when the safety device 10 is located properly therein. Preferably, the outer end 44 has a distinctive shape, including, for example, a fin 50 to clearly distinguish its shape from that of a magazine, which has a flat bottom end. Additionally, at least the outer end 44 of the main body is preferably of a bright color which clearly contrasts against the color of the pistol 12, making it easy to verify at a considerable distance that the safety device 10, and not a magazine, is located within the magazine well 34. The bottom plate 46 extends forward beyond the forward-most extent of the butt 48, making the safety device 10 visible to an observer who has a view of the pistol 12 from nearly any direction. For example, an observer standing forward of a person carrying the pistol 12 in a hip holster would thus be able to see a portion of the bottom plate 46 and identify the safety device 10 by the color of the bottom plate 46.

A chamber-blocking member 52 is pivotably attached to the main body 36, near the inner end 42, by a pivot pin in the form of a fastener such as a rivet 54 extending laterally through the main body 36 and through an elongated hole 56 defined in an ear 57 which extends generally vertically and from front to rear alongside the main body 36. A base plate portion 58 is horizontal and extends forwardly beneath the breech block 22 to a location beyond the front side 38 of the inner end 42 of the main body 36, when the safety device 10 is located operatively within the pistol 12. At a forward end of the base plate 58 is a breech barrier 60 which extends upwardly between the front face 24 of the breech block 22 and the loading ramp 19 located in the lower rear portion of the chamber 16.

Figure 3:
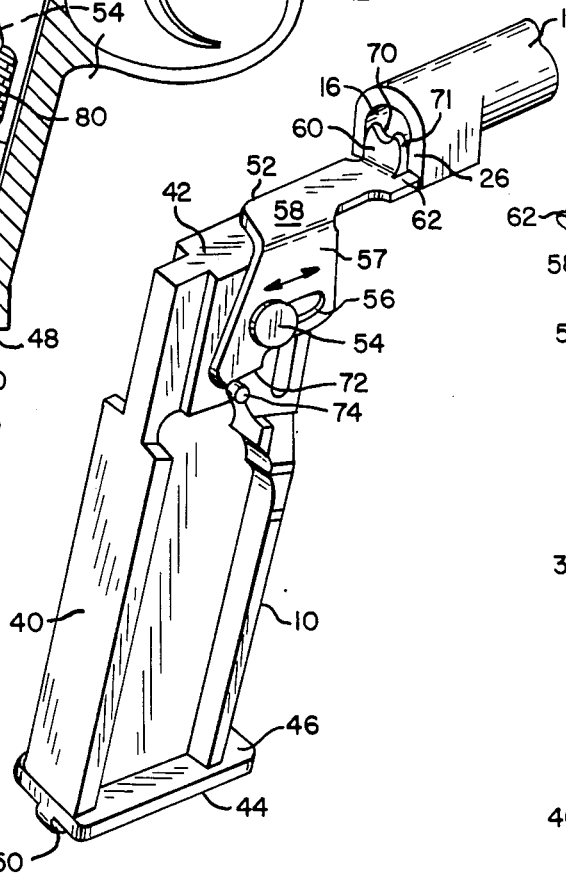
FIG. 3 is a perspective view of the safety device shown in FIG. 1, together with a portion of the barrel of the pistol shown in FIG. 1, taken from the upper right rear of the pistol.
Figure 4:
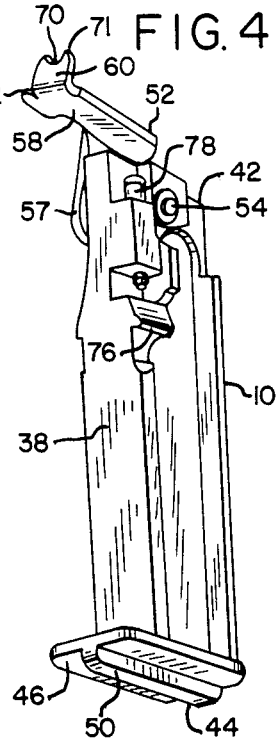
FIG. 4 is a perspective view of the safety device shown in FIG. 1, taken from the lower left front thereof.

As may be seen better in FIGS. 3 and 4, a locator tab 62, located at the right forward corner of the base plate 58, abuts against the breech face 26 and thus prevents the forward end of the base plate 58 from contacting the loading ramp 19, where it might cause damage. Nevertheless, because of the clearance provided for the base of a cartridge, as a feature of the design of the pistol 12, the breech block 22 can move to its normal forward-most position when the safety device 10 is in place.

The entire chamber-blocking member 52 is made of sheet steel, preferably hardened, having a thickness 64 which is at least as great as the maximum protrusion distance 32 of the firing pin 28. The breech barrier 60 prevents discharge of any cartridge located in the chamber 16 ahead of the breech barrier 60, then, by preventing the firing pin 28 from impacting against the primer of a cartridge in the chamber 16. With the cartridge 66, a cartridge having the same diameter but a shorter length than the cartridge intended to be fired in the pistol 12, located in the chamber 16, it is possible for the safety device 10 be installed through the magazine well in the normal fashion. The breech barrier 60 then prevents the cartridge 66 from being discharged, while permitting the action of the pistol 12 to be exercised safely for training purposes. When a cartridge 68, of the size intended to be fired in the pistol 12, is located in the chamber 16, the breech barrier 60 will abut against the base of the cartridge 68, as shown in FIG. 6, preventing the slide 20, including the breech block 22, from traveling as far forward as is normal and required for the pistol 12 to be fired normally. This, depending on the design of the pistol, may prevent the hammer 30 from moving the firing pin 28, making the pistol safe. In any case, however, because of the thickness 64 of the breech barrier 60, the firing pin 28 is prevented by the breech barrier 60 from striking the primer in the base of the cartridge 68, keeping the pistol 12 safe, even though the cartridge 68 is located within the chamber 16.

Additional safety is provided by a notch 70 defined in the upper margin 71 of the breech barrier 60. The location of this notch corresponds with the location of a primer in the base of a cartridge 66 or 68, to avoid contact between the breech barrier 60 and the centrally-located primer, so that the breech barrier 60 cannot cause discharge of a cartridge 66 or 68. Additionally, the notch 70 provides space for the forward end of the firing pin 28 to protrude forwardly from the front face 24 of the breech block 22 when the weapon is used in training. With the safety device 10 installed in the pistol 12, then, a trainee can practice squeezing the trigger without risking damage to the firing pin 28 which might occur should the forward end of the firing pin 28 strike against a hard metal object, rather than the relatively soft metal of a primer of a cartridge. Additionally, the provision of the notch 70 makes it more difficult for a person to grind away all or a portion of the breech barrier 60, in an attempt to disable the safety device, 10, without clearly and noticeably altering the shape of the breech barrier 60.

Referring now to FIGS. 2 and 7, it will be more fully appreciated that the elongated hole 56 in the ear 57 permits the chamber-blocking member 52 to slide rearwardly from its position as shown in FIG. 1. A limit stop portion 72, a flat surface on the lower rear corner of the ear 57, engages a protrusion such as the pin 74 extending laterally from the main body 36. This engagement of the limit stop 72 against the pin 74, and the location of the bottom side of the base plate 52 close to the surface of the inner end 42, maintain the base plate 58 in a horizontal position, parallel with the surface of the inner end 42 of the main body 36. The breech barrier 60 is thus kept located properly aligned with the chamber 16 when the chamber-blocking member 52 is in a forwardly located position with respect to the main body 36, as shown in FIGS. 1 and 3, in which the rivet 54 is in the rearward portion of the elongated hole 56. With the chamber-blocking member 52 in this position, however, the safety device 10 cannot be inserted into the magazine well 34, because of the forward extension of the chamber-blocking member 52. Therefore, the chamber-blocking member 52 may be slid rearwardly with respect to the main body 36, so that the rivet 54 extends through the forward portion of the elongated hole 56, and the limit stop 72 is clear of the pin 74. The chamber-blocking member 52 is then free to pivot about the rivet 54 to the position shown in FIG. 2.

When the chamber-blocking member 52 is in the rearwardly located, upwardly pivoted position shown in solid line in FIG. 2, the breech barrier 60 extends no further forward than the front side 38 of the main body 36, and the safety device 10 may be inserted into the magazine well 34 to the position shown in FIG. 1. This must be done with the slide 20 in its open, rearwardly-located position. Thereafter, releasing the slide 20 to permit it to return to its forward, closed, position carries forward the chamber-blocking member 52, as the breech block 22 engages the breech barrier 60, tilting the chamber-blocking element 52 downward to the horizontal and carrying it forward. The elongated hole 56 permits the chamber-blocking member 52 to slide forward with respect to the main body 36, until the locator tab 62 engages the breech face 26, or until the breech barrier 60 engages the base of a cartridge, as shown in FIG. 6. Unless the safety device 10 is thus fully inserted, it will extend clearly recognizably too far from the magazine well 34, indicating that the pistol 12 may not be safe.

Removal of the safety device 10 will require the chamber-blocking member 52 to be moved to the rearwardly located, upwardly pivoted position, with the slide 20 open. It will be appreciated that the required linear and pivoting movements may be provided by other arrangements as well as the one shown, and that certain limitations will result from the design of firearms with which it is intended to use a device of this type.

A catch 76 is provided on the main body 36 to engage a movable portion of a latch within the pistol 12 in the same manner in which a magazine for the pistol is engaged, so that the magazine latch of the pistol 12 retains the main body 36 within the magazine well 34.

A plunger 78 is biased upwardly by a spring 80 to act upon a slide latch (not shown) in the manner in which the follower of a magazine (not shown) acts to latch the slide 20 in its rearward, open, position after discharge of the final round which was originally contained in the magazine.

Referring now to FIG. 7, a safety device 90 which is an alternative embodiment of the invention includes a main body 92 having an outer end 94 including a bottom plate 96 and a fin 98. As does the main body 36 of the safety device 10, the main body 92 has a shape which fits within the magazine well 34. At an inner end 100 of the main body 92, a flexible cable 102 extends slidingly through a bore 104, and a stopper 106 is fixedly attached to a lower end of the cable 102, within a cavity 108 defined within the main body 92. The cavity 108 is enough larger than the stopper 106 to permit some movement of the cable 102 into and out of the cavity 108. A chamber-blocking element in the form of a plug 110 is fixedly attached to an opposite end of the cable 102. The plug 110 is generally cylindrical and preferably is of a size similar to that of the casing of the cartridge 68 which the chamber 16 is intended to accept. The cable 102 extends diagonally into a cylindrical side portion of the plug 110, so that the cable 102 lies along the loading ramp 19, extending beneath the breech block 22 to the bore 104, when the safety device 90 is located operatively within the pistol 12. A depression 112 is defined in a rear face 114 of the plug 110, to provide clearance for the firing pin 28 during training with respect to the pistol 12 when the safety device 90 is installed therein.

As with the safety device 10, a catch (not shown) may be provided to retain the main body 92 within the magazine well 34, and a spring-biased plunger (not shown) may be provided to actuate a slide latch.

The safety device 90 may be installed by inserting it upwardly into the magazine well 34, with the plug 110 preceding the main body 92, when the slide 20 is in its rearwardly-located, open, position. The plug 110 must be inserted manually into the chamber 16, after which the action of the pistol 12 may be operated, with the cable 102 extending forward beneath the breech block portion 22 of the slide 20, so that the slide 20 may be moved forward to its fully closed forward position. The length of the cable 102 and size of the main body 92 and the plug 110 prevent the main body from being fully inserted into the magazine well with the slide 20 in its forward, closed position unless the plug 110 is in the chamber 16. Similarly, the plug 110 can be inserted fully in the chamber 16 only when the main body 92 is located at least nearly all of the way into the magazine well 34.

Using either the safety device 10 or the safety device 90 according to the present invention the inner mechanisms of a firearm such as the pistol 12 are protected against intrusion of dirt by the outer end of the main body, which closes the magazine well against such unwanted materials, and by closing the action of the firearm in the normal manner. The safety device according to the invention provides a distinctively different appearance from that of a normal magazine carried in such a firearm, making it clearly evident that the firearm is safe to be used in a fashion simulating actual shooting. The chamber-blocking member 52 or the chamber-blocking plug 110 make it impossible for a cartridge to be discharged through the barrel of the weapon equipped with the safety device of the present invention.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A safety device for use in a firearm, of the type having a barrel defining a cartridge receiving and firing chamber having a breech opening, a longitudinally movable breech-closing member, and a magazine well for receiving and holding a removable magazine capable of holding a cartridge to be fed into the cartridge receiving and firing chamber, the safety device comprising:

(a) a main body of a size and shape which fits within said magazine well, preventing insertion of a magazine thereinto, said main body including an inner end and an outer end;

(b) a chamber-blocking element; and (c) connecting means attached to said main body for connecting said chamber-blocking element movably thereto, said chamber-blocking element being movable between a first position, in which said chamber-blocking element is aligned with said main body so that said main body can be inserted into said magazine well preceded by said chamber-blocking element, and a forwardly located second position in which at least a portion of said chamber-blocking element obstructs said breech opening, preventing insertion of a cartridge into said cartridge receiving and firing chamber.

2. The safety device of claim 1 wherein said connecting means comprises fastening means for attaching said base plate pivotably to said main body.

3. The safety device of claim 1, said main body including an outer end at least large enough to close said magazine well when said safety device is located operatively in said firearm.

4. The safety device of claim 1, said firearm including a slide latch and said main body including plunger means located thereon, for operating said slide latch.

5. The safety device of claim 1 wherein said chamber-blocking element comprises a base plate and a breech barrier portion attached to said base plate and located rearwardly adjacent said breech opening of said cartridge receiving and firing chamber, preventing insertion of a cartridge into said chamber, when said safety device is located operatively in a firearm and said chamber-blocking element is in said second position.

6. The safety device of claim 5, said connecting means including an ear connected with said base plate, said ear defining an elongated hole, and said safety device further including a pivot pin extending laterally through said elongated hole into said main body, connecting said chamber-blocking member to said main body so as to be pivotable and slidable with respect thereto.

7. The safety device of claim 1 wherein said main body includes an outer end which, when said safety device is installed operatively in said firearm, extends outward from said magazine well, a distance visibly and noticeably greater than a distance to which a magazine protrudes when located in said magazine well.

8. The safety device of claim 1, wherein said chamber-blocking member is a generally cylindrical plug, said connecting means including an elongate flexible cable extending between said plug and said main body, said cable being long enough to permit said plug to be inserted in said cartridge receiving and firing chamber only when said main body is located within said magazine well.

9. The safety device of claim 5, including locator tab means associated with said base plate, for extending from said base plate portion toward said barrel and limiting movement of said breech barrier into said cartridge receiving and firing chamber.

10. The safety device of claim 5, said barrel of said firearm including a breech end having a breech face, and said cartridge receiving and firing chamber including a loading ramp portion thereof, said base plate portion of said chamber-blocking member including a position limiting member located thereon and extending an appropriate distance to engage said breech face and prevent said breech barrier from contacting said loading ramp.

11. The safety device of claim 5, said firearm including a firing pin having a maximum protrusion from said breech-closing member, and said breech barrier having a thickness at least equal to said maximum protrusion.

12. The safety device of claim 5, said breech barrier including an upper margin defining a notch therein.

13. The safety device of claim 5 wherein said base plate extends forward and is located beneath and clear of the path of said longitudinally movable breech closing member when said chamber-blocking member is in said second position, when said safety device is operatively located in said firearm.

14. The safety device of claim 6, including limit stop located on said ear, and said main body including means located thereon for engaging said limit stop and thereby requiring said chamber-blocking member to be pivoted to a predetermined orientation with respect to said main body when said pivot pin is located within a predetermined portion of said elongated hole.

15. The safety device of claim 6, said chamber-blocking member being pivotable with respect to said main body to said first position when said pivot pin is located within a predetermined portion of said elongated hole.

16. The safety device of claim 6, said chamber-blocking member extending forwardly from said main body toward said cartridge receiving and firing chamber, and said breech barrier of said chamber-blocking member being located rearwardly adjacent said cartridge receiving and firing chamber, when said safety device is operatively located in said firearm and said pivot pin is located in a predetermined portion of said elongated hole.

17. The safety device of claim 7, said outer end having a distinctive shape different from the shape of a corresponding portion of a magazine for said firearm.

18. The safety device of claim 7, said outer end having a color contrasting clearly with the color of said firearm.

19. The safety device of claim 8, said plug including a rear face defining a centrally-located cavity therein.

20. The safety device of claim 8, said plug being of approximately the same size as a casing of a cartridge of a size which is intended to be fired from said firearm.

* * * * *

UNITED STATES PATENT AND TRADEMARK OFFICE

CERTIFICATE OF CORRECTION

PATENT NO. : 4,619,062

DATED : October 28, 1986

INVENTOR(S) : David A. Johnson

It is certified that error appears in the above-identified patent and that said Letters Patent is hereby corrected as shown below:

| | |
|---|---|
| Col. 2, Line 50 | Change "device" to --devices-- |
| Col. 3, Line 23 | Change "firearms" to --firearm-- |
| Col. 5, Line 43 | Change "at" to --on-- |
| Col. 8, Line 62 | Change "1" to --5-- |

Signed and Sealed this

Tenth Day of March, 1987

*Attest:*

DONALD J. QUIGG

*Attesting Officer*

*Commissioner of Patents and Trademarks*